US008256117B2

(12) United States Patent
Hennig

(10) Patent No.: US 8,256,117 B2
(45) Date of Patent: Sep. 4, 2012

(54) METHOD FOR THE CONTROLLED SHOT PEENING OF BLISK BLADES WHEREIN A SHOT PEENING STREAM IS PROVIDED ON A PRESSURE AND A SUCTION SIDE OF THE BLADES

(75) Inventor: Wolfgang Hennig, Simmern (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 380 days.

(21) Appl. No.: 12/379,552

(22) Filed: Feb. 24, 2009

(65) Prior Publication Data

US 2010/0212157 A1 Aug. 26, 2010

(51) Int. Cl.
*F01D 5/14* (2006.01)
*C21D 7/06* (2006.01)

(52) U.S. Cl. ..... 29/889.7; 29/889.2; 451/38; 72/53

(58) Field of Classification Search ..... 29/889.7, 29/889.2, 907.7, 889.23, 90.7; 451/39, 38; 72/53

See application file for complete search history.

(56) References Cited

U.S. PATENT DOCUMENTS 2,117,648 A * 5/1938 Bottorf ..... 451/76
2,439,032 A 4/1948 Almen
3,482,423 A * 12/1969 Smith et al. ..... 72/53
4,329,862 A * 5/1982 Harburn et al. ..... 72/53
4,426,867 A * 1/1984 Neal et al. ..... 72/53
4,454,740 A * 6/1984 Neal et al. ..... 72/53
4,616,496 A * 10/1986 Hawkins ..... 72/53
5,107,631 A * 4/1992 Wern ..... 451/28
5,314,545 A * 5/1994 Folts et al. ..... 134/22.11

(Continued)

FOREIGN PATENT DOCUMENTS

CA 2368288 7/2002

(Continued)

OTHER PUBLICATIONS

Semiatin, S.L. (2006; 2009). ASM Handbook, vol. 14B—Metalworking: Sheet Forming.. ASM International. Online version available at: http://www.knovel.com/web/portal/browse/display?_EXT_KNOVEL_DISPLAY_bookid=3132&VerticalID=0.*

(Continued)

*Primary Examiner* — David Bryant
*Assistant Examiner* — Jason L Vaughan
(74) *Attorney, Agent, or Firm* — Timothy J. Klima; Shuttleworth & Ingersoll, PLC

(57) ABSTRACT

A controlled shot-peening of blisk blades (1) uses a stream of spherical shot-peening medium transported by compressed air or water. The shot is driven essentially at a right angle onto each blisk blade individually, actually simultaneously on both blade sides, and with identical impact intensity and immediately opposite on both sides in several side-by-side processing paths extending over the entire blade surface. A dual-nozzle unit (6) is linearly moveable in two directions normal to each other, and swivellable about an X and a Y axis. The unit (6) includes two preferably rectangular, essentially parallel arranged, shot-peening nozzles (7), whose spacing is settable in accordance with the blade profile, each of which has a nozzle opening situated at the same level and facing the pressure or the suction side of the respective blisk blade, and featuring identical distance to the respective blade surface during shot-peening.

10 Claims, 3 Drawing Sheets

U.S. PATENT DOCUMENTS

Figure 1:
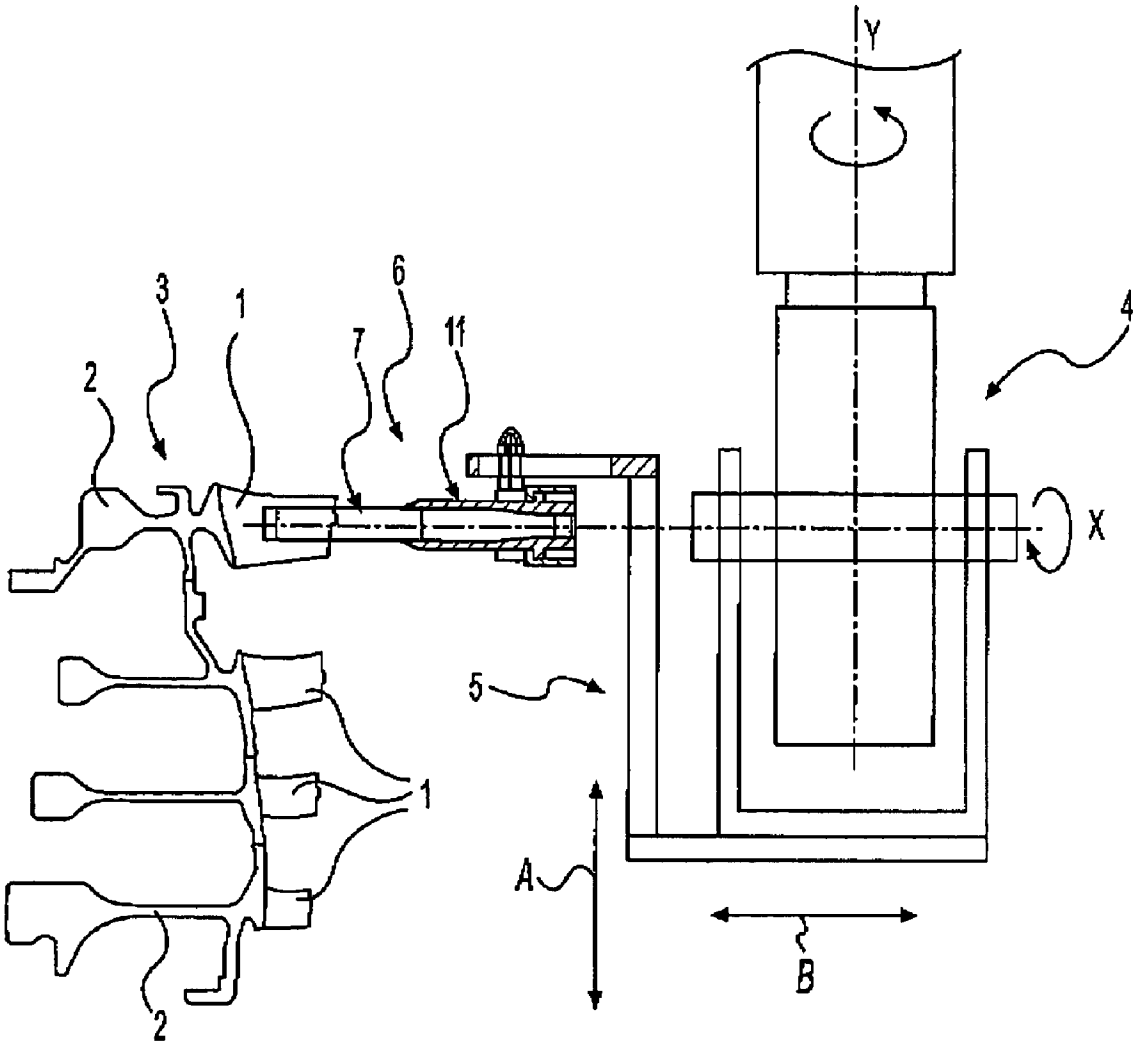

| | | | | |
|---|---|---|---|---|
| 5,476,363 | A * | 12/1995 | Freling et al. | 415/173.1 |
| 5,596,912 | A * | 1/1997 | Laurence et al. | 76/107.1 |
| 5,885,133 | A * | 3/1999 | Williams, Jr. | 451/40 |
| 5,948,293 | A * | 9/1999 | Somers et al. | 219/121.85 |
| 5,988,188 | A * | 11/1999 | Born | 134/22.11 |
| 5,998,755 | A * | 12/1999 | Zajchowski et al. | 219/76.16 |
| 6,037,004 | A * | 3/2000 | Zajchowski et al. | 427/282 |
| 6,490,899 | B2 * | 12/2002 | Berthelet et al. | 72/53 |
| 6,541,733 | B1 * | 4/2003 | Mannava et al. | 219/121.85 |
| 6,551,064 | B1 * | 4/2003 | Mannava et al. | 416/223 A |
| 6,694,789 | B2 * | 2/2004 | Yamamoto et al. | 72/53 |
| 6,938,448 | B2 * | 9/2005 | Kennerknecht et al. | 72/53 |
| 6,969,821 | B2 * | 11/2005 | Mika et al. | 219/121.83 |
| 7,028,378 | B2 * | 4/2006 | Cheppe et al. | 29/90.7 |
| 7,125,322 | B1 * | 10/2006 | Champaigne | 451/89 |
| 7,140,216 | B2 * | 11/2006 | Garza | 72/53 |
| 7,159,425 | B2 * | 1/2007 | Prevey et al. | 72/53 |
| 7,181,944 | B2 * | 2/2007 | Wuestefeld et al. | 72/53 |
| 7,217,102 | B2 * | 5/2007 | Rockstroh et al. | 416/235 |
| 7,582,174 | B2 * | 9/2009 | Vigneau | 148/565 |
| 7,647,800 | B2 * | 1/2010 | Cheppe et al. | 72/53 |
| 7,784,181 | B2 * | 8/2010 | Nocciolini et al. | 29/889.23 |
| 2003/0024915 | A1 * | 2/2003 | Clauer et al. | 219/121.85 |
| 2004/0238509 | A1 * | 12/2004 | Clauer et al. | 219/121.85 |
| 2006/0174483 | A1 * | 8/2006 | Bayer et al. | 29/889.2 |
| 2009/0165519 | A1 * | 7/2009 | Berndt et al. | 72/53 |
| 2010/0043512 | A1 * | 2/2010 | Bayer et al. | 72/53 |
| 2010/0125990 | A1 * | 5/2010 | Bayer et al. | 29/90.7 |
| 2010/0221118 | A1 * | 9/2010 | Prevey, III | 416/241 R |
| 2010/0287772 | A1 * | 11/2010 | Hennig et al. | 29/889 |

FOREIGN PATENT DOCUMENTS

| | | |
|---|---|---|
| DE | 60100931 | 7/2004 |
| EP | 0927773 | 7/1999 |
| EP | 1741796 | 1/2007 |
| GB | 615462 | 1/1949 |
| WO | 02/10332 | 2/2002 |
| WO | 2005/065885 | 7/2005 |

OTHER PUBLICATIONS

German Search Report dated Jun. 26, 2008 from counterpart German patent application.

European Search Report dated Jun. 19, 2009 from counterpart application.

* cited by examiner

METHOD FOR THE CONTROLLED SHOT PEENING OF BLISK BLADES WHEREIN A SHOT PEENING STREAM IS PROVIDED ON A PRESSURE AND A SUCTION SIDE OF THE BLADES

This application claims priority to German Patent Application DE102008010847.2 filed Feb. 25, 2008, the entirety of which is incorporated by reference herein.

This invention relates to a method for controlled shot-peening of blisk blades using a stream of spherical shot-peening medium driven onto the blade surfaces by compressed air or water and to an apparatus for the performance of said method.

In the case of controlled shot-peening of workpieces, the surfaces to be processed are impacted by a spherical shot-peening medium delivered at high speed by compressed air. Deformation of the workpiece surface into a multitude of cup-like depressions induces residual compressive stresses which reduce the hazard of crack formation and improve fatigue strength. Further benefits are weight reduction, work hardening and increased service life. As is generally known, controlled shot-peening is routinely used for engine components and here also for the treatment of the blades of blisks.

Under the aspects of reliability, weight reduction, performance increase and service life, gas-turbine rotors, and in particular the rotors of the compressors of gas-turbine engines, are provided with a blading which is integrally formed on the annular periphery of a disk. Such components are termed "blisks", with the term "blisk" being a shortened form of "blade integrated disk". As is generally known, blisks are manufactured by welding, in particular friction welding, separately manufactured blades to the peripheral annular surface of the preferably forged disk or by a cutting or chemical stock removal process starting at the outer annular surface of the disk. Upon forming and finish-machining of the blades and following heat treatment of the blisk, or a blisk drum including several blisks joined by welding, the blisk blade surfaces can be treated by shot-peening to improve their strength and service life in that residual compressive stresses are induced into the surface layer.

Peening of the closely spaced as well as curved and twisted blisk blades is accomplished by a shot stream delivered from the outside into the blade interspaces. However, mutual overlap, or shielding, and restricted accessibility of the blade surfaces, as particularly encountered on blisk drums, compromise the effectiveness of the peening medium stream on the blade surfaces as the peening medium hits the respective surface areas to an insufficient degree and at an unfavorable angle and, accordingly, with insufficient kinetic energy. Therefore, the degree of surface strengthening of the blades will be inadequate and non-uniform. Moreover, non-uniform loading of the pressure and suction sides can result in deformation of the blades. This disadvantage is not, or only partly, removable by higher peening speed and larger shot size, especially since the hazard of blade deformation is even further increased and areas with very small radii may be untreatable or intricate blade edges damaged with higher operating pressure and larger shot size and the change in peening parameters involved.

In another known method for controlled shot-peening of blisk blades, the individual blades are arranged in hermetically sealed chambers containing shot-peening medium which is ultrasonically set in motion. However, this method is disadvantageous in particular because of the high investment and effort incurred for enveloping the blades.

In a broad aspect the present invention provides a method for controlled shot-peening of the blades of blisks and blisk drums which ensures uniform and high surface strengthening of the blades with low effort and investment and without affecting the blade shape, and an apparatus for the performance of said method.

The core of the present invention is that each individual blisk blade is separately processed using shot streams which simultaneously—and immediately oppositely—and with identical peening intensity and essentially vertically strike the suction side and the pressure side as they are moved over the two side faces of the respective blisk blade in side-by-side processing paths. Identical peening intensity on both blade sides is achieved in that the distance between the stream exit plane and the peened surface is approximately equal on both blade sides.

With such a shot-peening process, uniform and intense surface strengthening is obtained in all regions of each individual blade of a blisk or blisk drum, actually without distorting the blisk blades and, in particular, their intricate edges in the peening process. The blisk blades are improved in strength, enabling fatigue strength to be increased and tensile stresses at the component surface to be eliminated. With the hazard of crack formation being minimized, service life is ultimately increased. The uniform, high peening intensity in all surface areas allows shot with small diameter to be used, enabling even small radii in the transition area to the annulus to be covered and strengthened by the shot-peening process.

In a further development of the present invention, the shot streams (shot-peening nozzles) have rectangular cross-section and are moved in the longitudinal direction of the blisk blades over the two blade surfaces in side-by-side, preferably overlapping processing paths. Overlap of the processing paths compensates for reduced peening intensity and shot coverage in the rim areas of the shot stream.

The apparatus according to the present invention for the performance of the method includes a dual-nozzle unit mounted on a motion unit and provided with two spaced apart, long shot-peening nozzles whose spacing is settable in accordance with the respective blade design and which have sideward nozzle openings of the same shape and size situated at the same level and facing each other. The motion unit enables the dual-nozzle unit with the shot-peening nozzles arranged on both blade sides during processing to be both moved in the longitudinal and transverse direction of the individual blisk blades and swivelled about an X and an Y axis, thereby enabling the shot streams to completely cover the blade surfaces and also follow the curved and twisted shape of the blisk blades at always the same distance and all blade regions to be treated with essentially equal peening intensity.

The shot-peening nozzles and the nozzle openings have rectangular cross-section or rectangular shot exit cross-section, respectively, enabling the blade surfaces to be uniformly shot-peened along wide, even processing paths.

In accordance with a further important feature of the present invention, the nozzle openings terminate, at the free front end of the shot-peening nozzles in a flat impingement plate oriented at an obtuse angle to the flow direction. At this impingement plate, the shot is deflected outward towards the blade surface at an angle which is equal to or partly larger than 90° so that the shot predominantly vertically hits the blade surfaces and the shot stream also covers the transition area of the blisk blade to the annulus. The length of the shot-peening nozzles is selected such that the shot discharged from the nozzle openings also covers the transition area.

Figure 3:
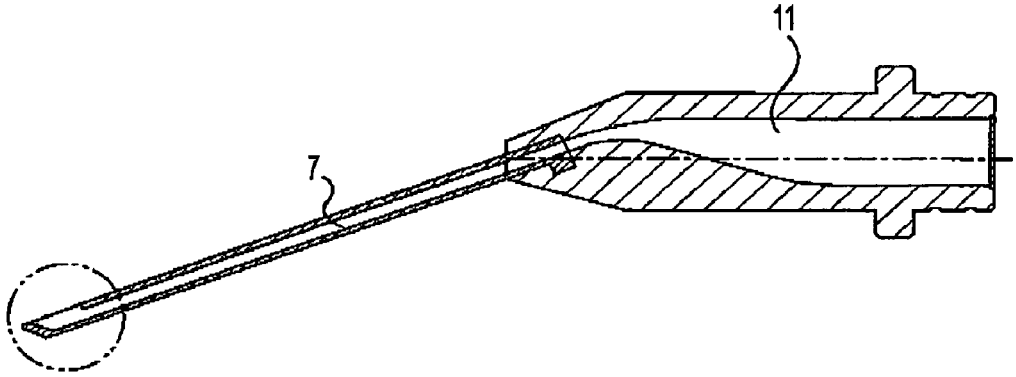
Figure 4:
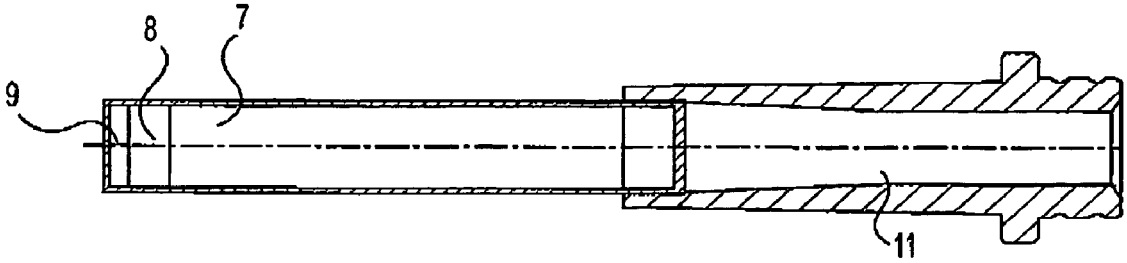
Figure 5:
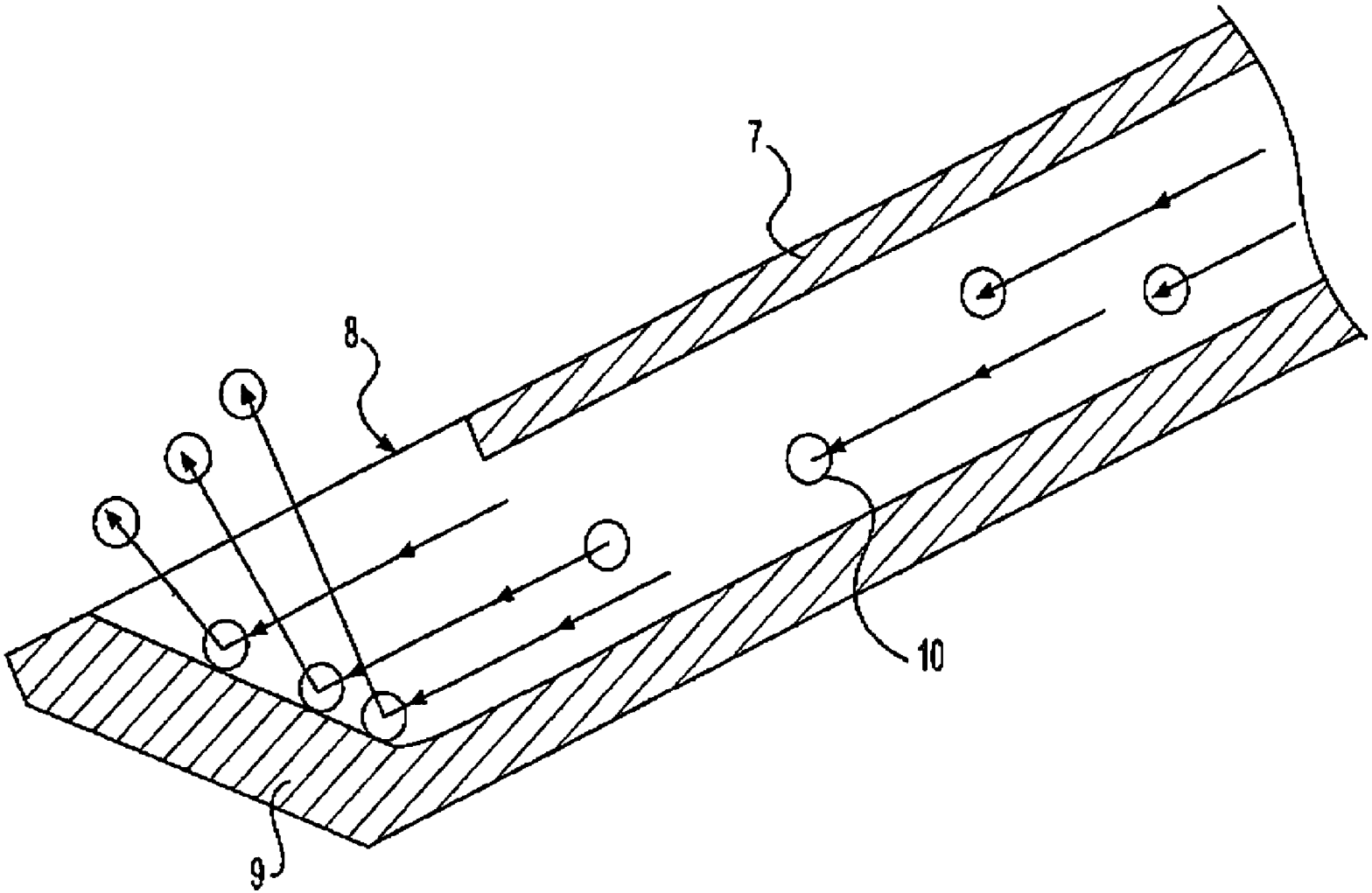

The present invention is more fully described in light of the accompanying drawings showing a preferred embodiment. In the drawings, FIG. 1 is a side view of an apparatus for controlled shot-peening of the blades of a blisk drum for the compressor of an aircraft engine, FIG. 2 is a top view of an apparatus for controlled shot-peening of the blades of a blisk drum, FIG. 3 is a vertical cross-section of a shot-peening nozzle, including shot guide, FIG. 4 is a horizontal cross-section of the shot-peening nozzle as per FIG. 3, and FIG. 5 is a detailed view of the shot-peening nozzle as per FIG. 3 in the area of the nozzle opening.

Figure 2:
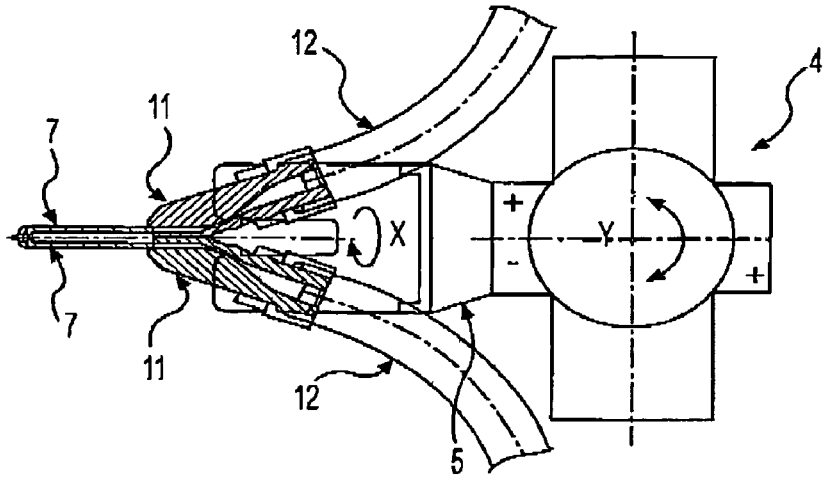

An apparatus shown in FIG. 1 or 2 for controlled shot-peening of the blisk blades 1 of a blisk drum 3 including several weld-joined blisks 2 has a motion unit 4 which enables a dual-nozzle unit 6 mounted on a nozzle holder 5 to be moved in vertical direction and in horizontal direction in accordance with the arrows A and B (see FIG. 1) and swivelled about a horizontal axis in accordance with arrow X and about a vertical axis in accordance with arrow Y (see FIG. 2).

The dual-nozzle unit 6 includes two shot-peening nozzles 7, each in the form of a flat, rectangular and long hollow body, which, with their wide side, are spaced apart and essentially parallel arranged opposite to each other. The distance between the two shot-peening nozzles 7 is adjustable and, in accordance with blade thickness, shape and distance, is set such that the shot-peening nozzles 7 will not interfere with the blisk blades 1 to be processed, or with neighboring blisk blades, during the shot-peening process. The length of the shot-peening nozzles 7 exceeds the maximum height of the blisk blades 1 to be processed. At their free forward end, the two shot-peening nozzles 7 each have a sideward—rectangular—nozzle opening 8 which essentially extends over their entire width. The closed front end of the nozzle opening 8 or the shot-peening nozzle 7, respectively, is formed by an impingement plate 9 inclined approximately at an angle of 45° at which the shot stream or the shot 10, respectively, supplied via the shot-peening nozzle 7 is deflected by approximately 90° or more, thus being discharged via the nozzle opening 8 approximately vertically to the longitudinal extension of the shot-peening nozzles 7 or the flow direction in the shot-peening nozzles 7, respectively. The nozzle openings 8 of the two shot-peening nozzles 7 are directed towards each other and arranged exactly opposite to each other.

At the end opposite of the impingement plate 9, the respective shot-peening nozzle 7 connects to a shot guide 11 which, in turn, connects to a shot supply line 12 with essentially circular cross-section. The inner cross-section of the shot guide 11 is designed such that the circular cross-section of the shot stream supplied via the shot supply line 12 by compressed air or water is gradually transformed into a cross-section corresponding to the rectangular inner cross-section of the shot-peening nozzles 7, i.e. without energy loss and swirling of the shot stream and with simultaneous increase of the speed of the shot.

For controlled shot-peening of the blisk blades 1 of a heat-treated blisk drum 3 which includes several weld-joined blisks 2, the dual nozzle unit 6 is moved by means of the motion unit 4 in the longitudinal direction of each of the individually processed blisk blades 1 in several—overlapping—processing paths. Overlap of the processing paths is required since the quantity of shot discharged is slightly smaller at the rims of the nozzle opening 8 than at its center. During processing, the blisk blade 1 is positioned centrally between the two shot-peening nozzles 7 so that, with the distance between the shot-peening nozzles 7 being set in accordance with the cross-sectional profile of the respective blisk blade, the opposite surface areas on the suction side and the pressure side of the blisk blade 1 are each exposed to a shot stream whose intensity, owing to the central positioning, is equal on both sides, thus avoiding deformation of the blisk blades 1 by unbalances or differences in the impact intensity of the shot stream. As the dual-nozzle unit 6 is moved along the processing paths, the dual-nozzle unit 6 is, in accordance with the arrows X and/or Y, swivelled such that the shot exit plane of the oppositely arranged nozzle openings 8 follows the twisted blade shape and is set essentially parallel and at the same distance to the blade surface.

Since the shot essentially vertically hits the surfaces to be processed, its impact energy is maximally utilized. Thus, shot with relatively small diameter can be used, enabling areas with small radii, for example in the transition area between the blade side surfaces and the annulus, to be processed and strengthened by shot peening. Individual processing of the blisk blades with the small-diameter peening shot bombarding only the side faces essentially vertically and with equal intensity prevents deformation, in particular of the intricate, easily distortable blade edges. With the above-described method, each individual blisk blade is processed with equal intensity on the pressure and on the suction side and shot-peened all-over. The residual compressive stresses induced in the surface layer equally on both sides lead to an improvement in strength and a reduced hazard of crack formation, thus increasing the service life of the blisk blades. Moreover, the increase in strength allows material to be saved and weight to be reduced.

LIST OF REFERENCE NUMERALS

1 Blisk blade
2 Blisk
3 Blisk drum
4 Motion unit
5 Nozzle holder
6 Dual-nozzle unit
7 Shot-peening nozzle
8 Nozzle opening
9 Impingement plate
10 Shot
11 Shot guide
12 Shot supply line

What is claimed is:

1. A method for controlled shot-peening of blisk blades, comprising:

providing at least two shot-peening streams of driven shot-peening medium;

using the at least two shot-peening streams to separately shot-peen each blisk blade along side-by-side processing paths, simultaneously on a pressure and on a suction side, on immediately opposite locations on surfaces of the pressure side and the suction side;

the at least two shot streams essentially vertically striking the pressure side and suction side blade surfaces and having essentially identical shot-peening intensity;

shot-peening each blisk blade separately as an integral part of a blisk rotor;

producing the shot streams with compressed air exiting from a shot-peening unit having dual opposed nozzles;

providing each nozzle with an elongated portion through which one of the two shot-peening streams is guided essentially parallel to a longitudinal axis of each blisk blade from a free tip of each blisk blade and between each blisk blade and an immediately adjacent blisk blade;

further providing each nozzle with an impingement plate inclined to direct the shot stream to essentially vertically strike the one of the pressure and suction side surface and positioned at a distal end of the elongated portion for redirecting the one of the two shot-peening streams from essentially parallel to the longitudinal axis of each blisk blade to essentially vertical to one of the pressure and suction side surfaces;

providing that the elongated portion of the nozzle extends a length sufficient to position the impingement plate at a base of each blisk blade between each blisk blade and the immediately adjacent blisk blade such that the impingement plate can be sequentially positioned directly adjacent to the one of the pressure and suction side surface providing that the elongated portion of the nozzle extends a length sufficient to sequentially guide the one of the two shot-peening streams essentially vertically along the one of the pressure and suction side surfaces; and moving and swiveling the shot-peening unit to follow along the suction side and pressure side surfaces to maintain the essentially vertical striking and essentially identical shot-peening intensity.

2. The method of claim 1, wherein each shot stream has a rectangular cross-section.

3. The method of claim 2, and further comprising shot-peening the pressure side and suction side blade surfaces with successive processing paths overlapping on the blade pressure side and suction side.

4. The method of claim 3, and further comprising setting a distance between a shot exit plane and the pressure side and suction side blade surfaces to be essentially equal on both blade sides in order to achieve identical peening intensity on both sides.

5. The method of claim 4, and further comprising aiming the respective shot-peening streams to hit the blade surfaces at essentially right angles.

6. The method of claim 5, and further comprising selecting a shot size such that even very small radii of the blade surfaces are reached by the shot-peening medium and strengthened by shot-peening.

7. The method of claim 1, and further comprising shot-peening the pressure side and suction side blade surfaces with successive processing paths overlapping on the blade pressure side and suction side.

8. The method of claim 1, and further comprising setting a distance between a shot exit plane and the pressure side and suction side blade surfaces to be essentially equal on both blade sides in order to achieve identical peening intensity on both sides.

9. The method of claim 1, and further comprising aiming the respective shot-peening streams to hit the blade surfaces at essentially right angles.

10. The method of claim 1, and further comprising selecting a shot size such that even very small radii of the blade surfaces are reached by the shot-peening medium and strengthened by shot-peening.

* * * * *